US005426931A

United States Patent [19]

Beitzinger et al.

[11] Patent Number: 5,426,931

[45] Date of Patent: Jun. 27, 1995

[54] BEARING SETUP FOR AN OPEN-END SPINNING ROTOR

[75] Inventors: Kurt Beitzinger; Eberhard Grimm; Edmund Schuller, all of Ingolstadt, Germany

[73] Assignee: Rieter Ingolstadt Spinnereimaschinenbau AG, Ingolstadt, Germany

[21] Appl. No.: 102,732

[22] Filed: Aug. 6, 1993

[30] Foreign Application Priority Data

Aug. 7, 1992 [DE] Germany ..... 42 26 194.5

[51] Int. Cl.[6] ..... D01H 4/12

[52] U.S. Cl. ..... 57/406; 384/444

[58] Field of Search ..... 57/104, 105, 906, 407; 384/444, 906

[56] References Cited

U.S. PATENT DOCUMENTS

| | | | |
|---|---|---|---|
| 3,805,506 | 4/1974 | Stahlecker | 57/406 X |
| 4,041,688 | 8/1977 | Stahlecker | 57/406 X |
| 4,051,654 | 10/1977 | Bartling | 57/406 |
| 4,070,814 | 1/1978 | Goldammer et al. | 57/406 X |
| 4,149,365 | 4/1979 | Kobayashi et al. | 57/104 |
| 4,186,548 | 2/1980 | Stahlecker . | |
| 4,574,577 | 3/1986 | Derichs et al. . | |
| 4,703,616 | 11/1987 | Feuchter et al. . | |
| 4,763,465 | 8/1988 | Raasch | 57/406 X |
| 4,763,469 | 8/1988 | Stahlecker et al. . | |
| 4,773,210 | 9/1988 | Landwehrkamp et al. . | |

FOREIGN PATENT DOCUMENTS

| | | |
|---|---|---|
| 3622523A1 | 1/1988 | Germany . |
| 4022562A1 | 1/1992 | Germany . |
| 4117175A1 | 11/1992 | Germany . |
| 1365275 | 8/1974 | United Kingdom . |

OTHER PUBLICATIONS

RU 14 Operating Manual, pp. A6–39 through A6–46, published Jul. 24, 1991.

*Primary Examiner*—Joseph J. Hail, III

*Attorney, Agent, or Firm*—Dority & Manning

[57] ABSTRACT

A bearing setup is provided for the supporting disks of an open-end spinning machine, the supporting disks being supportively fixed on the ends of a shaft extending through a bearing sleeve of a supporting disk bearing. The bearing setup includes a fastening system configured with the bearing sleeve so that the supporting disk bearing can be readily and easily removed from the pillow block of the spinning machine without disassembly of the pillow block from the machine frame. The fastening system may include a threaded bore defined in the axial sleeve for engagement with a threaded screw member extending through the pillow block.

14 Claims, 4 Drawing Sheets

BEARING SETUP FOR AN OPEN-END SPINNING ROTOR

BACKGROUND OF THE INVENTION

The instant application relates to a bearing method for an open-end spinning rotor as well as to a supporting disk bearing for a spinning rotor.

A method by which the individual sections of the rotor spinning machine are equipped with a U-shaped support, in the interior of which the supporting disks of the spinning rotor are located is known from the rotor spinning machine RU14 of the company Rieter Ingolstadt, D-85046 Ingolstadt. The pillow block which receives the supporting disk bearings is mounted on a bearing plate which is in turn screwed on the horizontal leg of the U-shaped support. To service the bearing, in particular to replace the supporting disks, it is necessary to remove the pillow block from the bearing plate or the latter from the U-shaped support and to pull it out of the spinning machine under the tangential belt which drives the rotor. The supporting disk bearing is attached on the pillow block via a clamping device which reaches over both supporting disk bearings and presses them into the seat on the pillow block.

The disadvantage of such a bearing method consists in the fact that the maintenance and disassembly of the bearing setup, in particular the replacement of the supporting disks, requires much effort. Once the fastening system of the bearing plate or of the pillow block has been removed, the bearing with the supporting disks and the axial bearing provided on the pillow block must be lifted out under the tangential belt and out of the U-shaped support. A replacement of the supporting disks is possible only in the disassembled pillow block. The type of attachment of the pillow block, and also of the bearing plate to the U-shaped support, makes it impossible to move the latter downward after disassembling it, so that the pillow block cannot be taken out below the tangential belt.

OBJECTS AND SUMMARY OF THE INVENTION

It is a principal object of the instant invention to provide a bearing setup for an open-end spinning rotor such that the disadvantages of the state of the art are avoided and the bearing setup can be serviced more easily and the supporting disk bearings can be assembled and disassembled with greater ease. It is a further object of the invention to design a supporting disk bearing in such manner that it can be easily mounted on a pillow block of a bearing setup for an open-end spinning rotor.

Additional objects and advantages of the invention will be set forth in part in the description which follows or may be learned by practice of the invention.

The objects are attained by the invention in that the bearing setup according to the invention makes it possible for the supporting disk bearing, and thereby also for the supporting disks, to be attached more easily to the pillow block of the bearing setup. If the supporting disk bearings are provided with their own attachment means it is possible to design the bearing setup so as to simplify the replacement of the supporting disk bearings. It is possible to remove the supporting disk bearings from the bearing setup and to replace them without disassembling the pillow block. It is especially advantageous for the fastening system on the supporting disk bearing to be made in the form of bores because these can be provided to great advantage with threads so that the supporting disk bearing can be attached to the pillow block by means of a screw, for example. After removal of this screw the supporting disk bearing, together with the supporting disks, can be removed easily from the bearing block.

It is especially advantageous for the seat of the supporting disk bearings to be provided with an opening through which the fastening system is accessible. This makes it possible to unscrew and to disassemble the supporting disk bearings from below, i.e. from the side of the supporting disk bearing setup away from the tangential belt of the bearing. The bearing setup is actually much more accessible from below because no drive means impede access to the bearing setup. It is especially advantageous for the supporting disk bearings to be provided with a one-piece sleeve because attachment is thereby greatly facilitated.

It is especially advantageous for the supporting disk bearing to be provided with one single fastening system and to locate the latter so that it is essentially centered. It is especially advantageous for the baring block to be designed so as to constitute a compact unit which is located substantially between the supporting disk bearings and so that essentially only the seats of the supporting disk bearings are located on the side of the unit. This makes it possible to guide the supporting disks together with their bearings laterally out of the pillow block and to remove it from same. Thus no impediment is created by parts of the pillow block located on the side. The supporting disks can be simply removed from the pillow block. It is also especially advantageous for the support of the axial bearing to be located between the seats of the supporting disk bearings on the pillow block, so that elements of the pillow block located laterally next to the supporting disks which would be in the way of the removal of the supporting disks can be omitted. Additional advantageous embodiments of the bearing setup are described in the figures and description which follows.

Thanks to the embodiment of the supporting disk bearing according to the invention, it is possible to attach the latter easily in a bearing setup. In particular with the further advantageous embodiments where the fastening system is made in form of a bore, the supporting disk bearings can be attached by means of standard components so that the bearing setup of an open-end spinning rotor can be designed to be simpler and less expensive. In the embodiment of the supporting disk bearing according to the invention it can also be centered at the same time over the fastening system and can be attached in a bearing for an open-end spinning rotor. It is especially advantageous if the fastening system is made in the form of a bore which is provided with threads. This makes it possible to screw the supporting disk bearing by means of a simple component to a supporting system of an open-end spinning rotor. It is also advantageously possible to attach a pin, e.g. a threaded pin to the supporting disk bearing, through which the supporting disk bearing can then be attached to the pillow block by means of a nut.

The invention is described below through drawings which form a part of this specification and, together with the description, serve to explain the principles of the invention.

DETAILED DESCRIPTION OF THE PREFERRED EMBODIMENTS

Figure 1:
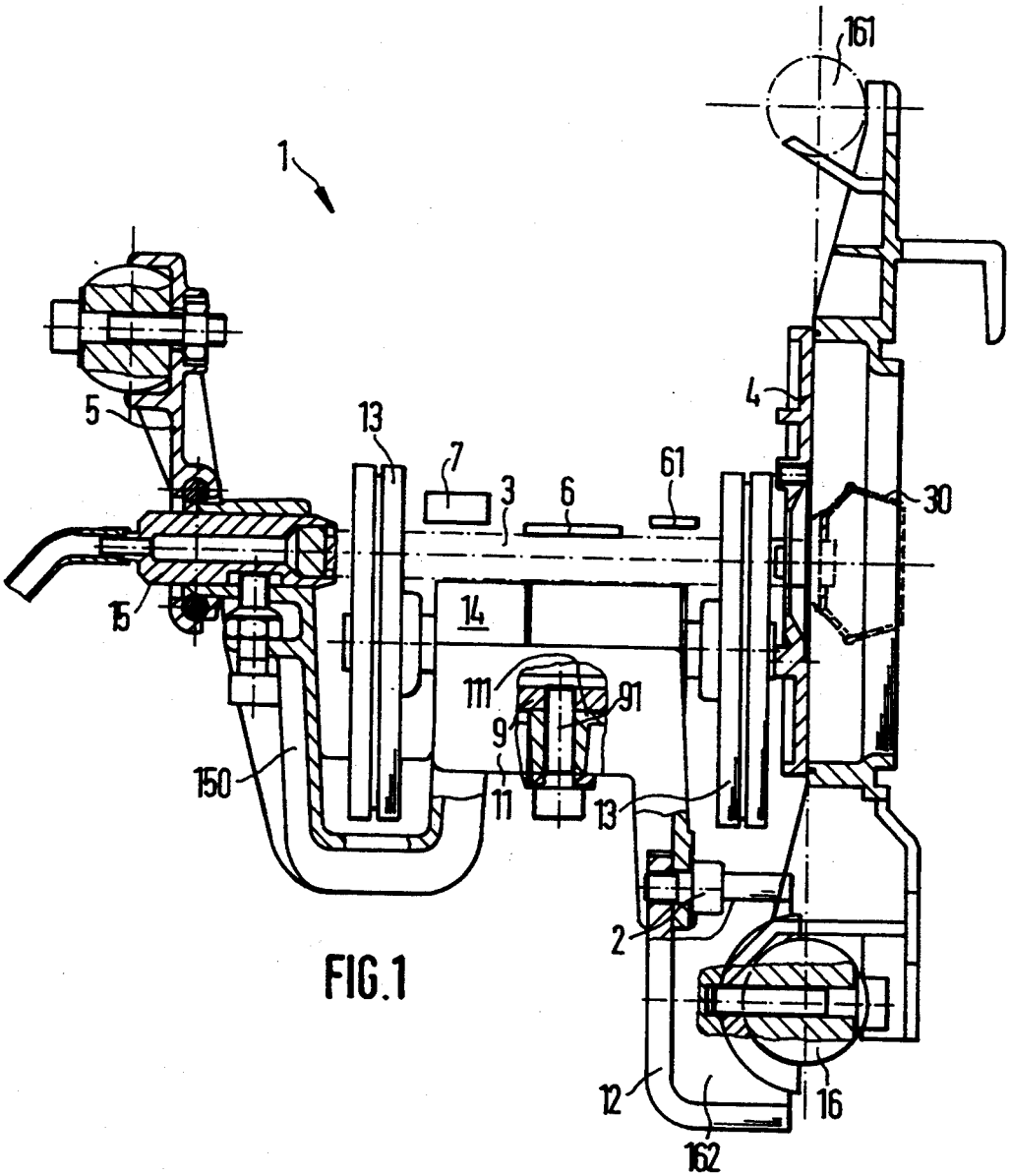
FIG. 1 shows an embodiment of the bearing setup of an open-end spinning rotor designed in accordance to the invention.

Reference will now be made in detail to the presently preferred embodiments of the invention, one or more examples of which are illustrated in the drawings. Each example is provided by way of explanation of the invention, not limitation of the invention. Various modifications and variations can be made in the invention without departing from the scope or spirit of the invention. The numbering of components in the drawings is consistent throughout the application, with the same components having the same number in each of the drawings.

The bearing setup of an open-end spinning rotor, the rotor bearing 1 of FIG. 1, consists of the pillow block 11, the bearing plate 12, the supporting disks 13 with their supporting disk bearing 14 and the axial bearing 15. The bearing plate 12 is mounted on a rod 16 of the machine frame. Support is provided via a damping element 162. The pillow block 11 is screwed to the bearing plate 12 by means of a screw 2. The pillow block 11 is centered on the bearing plate 12 by means of centering pins in the bearing plate. Shaft 3 of the spinning rotor 30 lies in the nip of two supporting disk pairs 13 of which only one is visible. Rotor 30 is located in the rotor housing 4 which bears upon rod 16 as well as on the additional support 161. In this case the rotor housing snaps into the support 161. The pillow block 11 supports the axial bearing 15 via support 150 and the axial bearing 15 bears advantageously in a damped manner upon a support 5 on the machine frame. The tangential belt 6 of the rotor drive as well as an additional tangential belt 61 for a different rotor speed are located above the rotor shaft 3. A brake 7 is also visible.

After removal of the rotor 30 and of the rotor housing 4, the pillow block 11 can be removed from its bearing plate 12 by loosening the screw 2. The axial bearing 15 is pulled out of support 5 by shifting the pillow block axially in direction of the rotor housing. Finally the pillow block can be lowered so that it can be pulled out below the tangential belt 6 and the additional tangential belt 61. The supporting disks need not be removed from the pillow block for this since lowering is sufficient.

In the rotor bearing 1 of FIG. 1 the supporting disks 13 are especially simple to replace due to the fact that the are equipped according to the invention with a fastening system in the form of bore 9. The latter interacts with a screw 91 which is screwed from below through seat 111 into the threads 60 of bore 9. To replace the supporting disks 13 together with their supporting disk bearing 14 the screw 91 is unscrewed from below, where the rotor bearing is easily accessible. As can be seen more clearly in FIG. 3, the supporting disk bearings are lifted up from the seat 111 after the removal of the screws and are lifted laterally over the pillow block 11 and out of the latter to the left and to the right. There is sufficient room here between the pillow block 11 and the tangential belt 6 for the supporting disk bearing 14 so that the supporting disks 13 can be removed without having to stop the spinning machine. Normally the tangential belt 6 is automatically lifted slightly for this, because the spinning rotor had been stopped earlier so that it could be removed. The newly inserted supporting disk bearings can be centered easily in the pillow block through the bore 9 in combination with screw 91 without requiring that the bearing setup be accessible from above. Only in special cases, e.g. when the axial bearing 15 is to be replaced, is the pillow block 11 detached from the supporting disk 12 through unscrewing of the screw 2 and the entire bearing setup is removed from the spinning machine. In this case too, the embodiment of the bearing setup according to the invention is advantageous, as the prior removal of the supporting disks makes it possible to pull out the pillow block 11 to the front and out of the spinning machine once the rotor housing 4 has been removed.

Figure 2:
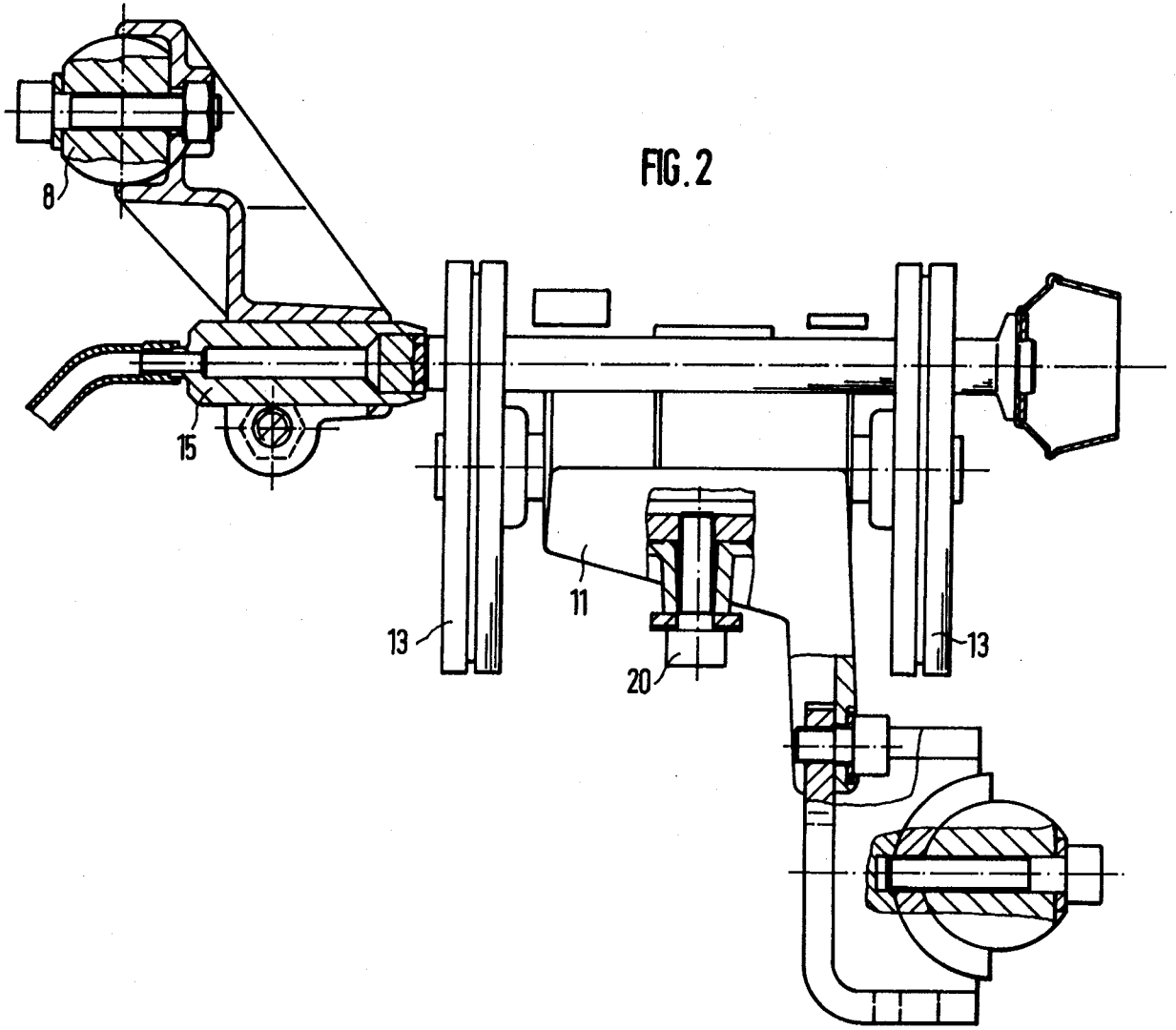
FIG. 2 shows another embodiment of an embodiment of the bearing setup according to the invention.
Figure 3:
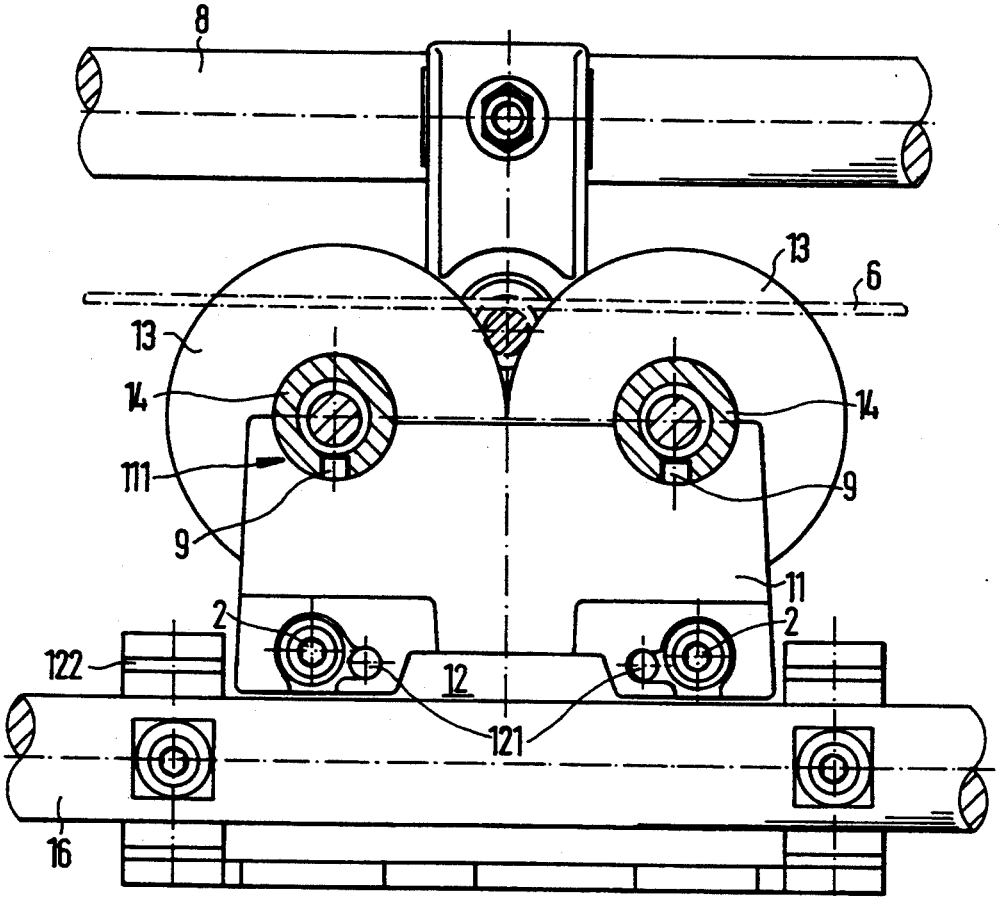
FIG. 3 shows a front view of a rotor bearing without rotor and without rotor housing, designed according to the invention.

FIG. 3 shows the bearing setup with the rotor housing removed. From FIG. 3 it is clear that the pillow block 11 can be easily removed from the spinning machine after removal of the supporting disks. It is especially advantageous here, as shown in FIG. 1, that the axial bearing can be simply withdrawn from its support 5 or, as in FIG. 2, that the axial bearing 15 is itself attached to the machine frame 8.

With the bearing setup according to the invention as shown in FIG. 2, the pillow block 11 can be made extremely short since the axial bearing 15 is supported directly on the machine frame 8. As a result, the handiness of the rotor bearing is improved considerably so that it becomes much easier to remove it. After removal of the pillow block 11, or of only the supporting disks 13, as is the case in the present embodiment as well as in FIG. 1, access to the axial bearing 15 is possible. The combination with the attachment of the pillow block 11 to the bearing plate 12 according to the invention, so that the pillow block itself is easier to handle, is especially advantageous.

FIG. 3 shows a front view of a bearing setup according to the invention. The pillow block 11 is attached to the bearing plate 12 by means of screws 2. Centering pins 121 ensure that the pillow box is positioned exactly in relation to the supporting plate 12. The bearing plate 12 is attached to the rod 16 which is part of the machine frame. This is done to greatest advantage via damping elements 122. The axial bearing is supported on the machine frame 8 which is made in form off a rod. The supporting disk bearings 14 are shown in cross-section going through the bore 9 according to the invention. The supporting disk bearings 14 are screwed to the pillow block 11 from below through this bore 9 (see also FIGS. 1 and 2).

Figure 4:
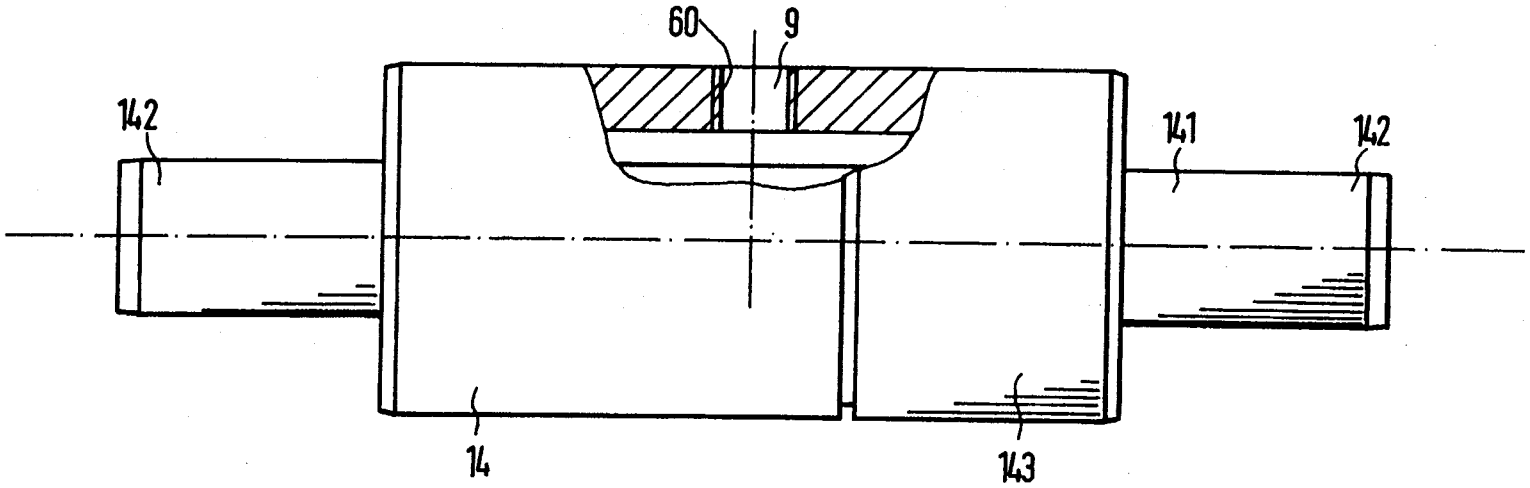
FIG. 4 shows a supporting disk bearing designed according to the invention, partially in section.

FIG. 4 shows a supporting disk bearing 14 designed according to the invention. The sleeve 143 contains a bore 9 which is shown in cross-section. Bore 9 is provided with threads 60 for the attachment of a screw 20 (see FIG. 2). The fastening system according to the invention can also be made advantageously in the form of a bolt which is clamped in the rotor bearing or in the form of a threaded pin. In the latter case the attachment to the pillow block can be effected by means of a nut. The supporting disk bearing 14 furthermore consists of a shaft 141 which is mounted in the sleeve 143 via bearings, e.g. roller bearings (not shown). The shaft is provided with seats 142 to which the supporting disks are attached (see FIG. 1).

It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

We claim:

1. A bearing setup for the spinning rotor of an open-end spinning machine, comprising:

a pillow block configured for mounting on the frame of the open-end spinning machine, said pillow block defining bearing seats;

pairs of supporting disks, each said pair of supporting disks supported on a shaft which is mounted in a supporting disk bearing, said supporting disk bearings received by said pillow block bearing seats; and a fastening system for removably attaching said supporting disk bearings to said pillow block, said fastening system being configured so that said supporting disk bearings and supporting disks can be removed from said pillow block without disassembling said pillow block from the open-end spinning machine frame, said fastening system comprising a bore defined in each supporting disk bearing and a corresponding bore defined through said pillow block, said supporting disk bearing bore alignable with said respective pillow block bore when said supporting disk bearing is seated in said pillow block bearing seat, and a removable attaching member inserted through said pillow block bore into said supporting disk bearing bore.

2. The bearing setup as in claim 1, wherein said bore in said supporting disk bearings is threaded, said attaching member being threaded for engagement with said threaded bore in said supporting disk bearing.

3. The bearing setup as in claim 2, wherein said attaching member is a screw member.

4. The bearing setup as in claim 1, wherein said supporting disk bearings comprise a one-piece sleeve which is received in said pillow block bearing seats.

5. The bearing setup as in claim 4, wherein said fastening system is axially centered along said one-piece sleeve.

6. The bearing setup as in claim 1, further comprising an axial bearing and an axial bearing support, said axial bearing support being carried by said pillow block.

7. The bearing setup as in claim 6, wherein said axial bearing support is U-shaped, at least two adjacent said supporting disks rotatable within said U-shaped support.

8. The bearing setup as in claim 1, further comprising a bearing plate and a dampening element, said pillow block attachable to the spinning machine frame through said bearing plate and said dampening element.

9. The bearing setup as in claim 8, wherein said bearing plate is attachable to the spinning machine frame in a plane substantially perpendicular to the plane of the axes of said supporting disks.

10. A supporting disk bearing for use with spinning rotor supporting disks of an open-end spinning machine, said supporting disk bearing comprising a sleeve for supportive reception of a shaft therethrough which is configured at its ends to receive supporting disks, said sleeve further comprising a fastening device configured therein wherein said supporting disk bearing can be removably mounted to a pillow block of an open-end spinning machine, said fastening device including a bore defined in said sleeve and a fastening device insertable into said bore through a corresponding bore in the pillow block.

11. The supporting disk bearing as in claim 10, wherein said fastening device is essentially centered along the axial length of said sleeve.

12. The supporting disk bearing as in claim 10, wherein said bore is threaded and said fastening device further comprises a screw member for threaded engagement with said threaded bore.

13. A bearing setup for the spinning rotor of an open-end spinning machine, comprising:

a pillow block configured for mounting on the frame of the open-end spinning machine, said pillow block defining bearing seats;

pairs of supporting disks, each said pair of supporting disks supported on a shaft which is mounted in a supporting disk bearing, said supporting disk bearings received by said pillow block bearing seats, said supporting disk bearings comprising a one-piece sleeve which is received in said pillow block bearing seats; and a fastening system for removably attaching said supporting disk bearings to said pillow block, said fastening system being configured so that said supporting disk bearings and supporting disks can be removed from said pillow block without disassembling said pillow block from the open-end spinning machine frame, said fastening system axially centered along said one-piece sleeve and includes a bore defined through said pillow block bearing seats and into said one-piece sleeve, and an attaching member inserted into said bores.

14. A bearing setup for the spinning rotor of an open-end spinning machine, comprising:

a pillow block configured for mounting on the frame of the open-end spinning machine, said pillow block defining bearing seats;

pairs of supporting disks, each said pair of supporting disks supported on a shaft which is mounted in a supporting disk bearing, said supporting disk bearings received by said pillow block bearing seats, said supporting disk bearings comprising a one-piece sleeve which is received in said pillow block bearing seats; and a fastening system for removably attaching said supporting disk bearings to said pillow block, said fastening system being configured so that said supporting disk bearings and supporting disks can be removed from said pillow block without disassembling said pillow block from the open-end spinning machine frame, said fastening system axially centered along said one-piece sleeve and includes a bore defined through said pillow block bearing seats and into said one-piece sleeve with at least said bore into said one-piece sleeve being threaded, and a threaded screw attaching member inserted into said bores.

* * * * *